United States Patent [19]

Phillips

[11] 4,232,761

[45] Nov. 11, 1980

[54] EXTENSIBLE LADDER

[76] Inventor: Reginald C. Phillips, Tracy, New Brunswick, Canada, E0G 3C0

[21] Appl. No.: 966,588

[22] Filed: Dec. 5, 1978

[30] Foreign Application Priority Data

Jan. 6, 1978 [CA] Canada ..... 293801

[51] Int. Cl.[2] ..... E06C 1/36; E06C 1/397

[52] U.S. Cl. ..... 182/195; 182/206; 182/208; 182/211

[58] Field of Search ..... 182/195, 206, 150, 207–210

[56] References Cited

U.S. PATENT DOCUMENTS

| | | | |
|---|---|---|---|
| 595,453 | 12/1897 | Fischer | 182/206 |
| 667,927 | 2/1901 | Weeks | 182/195 |
| 2,836,336 | 5/1958 | Hansen | 182/208 |
| 2,874,887 | 2/1959 | Pompilio | 182/195 |
| 3,946,833 | 3/1976 | Riehlmann | 182/195 |

*Primary Examiner*—Reinaldo P. Machado
*Attorney, Agent, or Firm*—Otto John Munz

[57] ABSTRACT

A portable, extensible ladder is disclosed of the type having a plurality of sections sliding into each other. The normally uppermost section is provided with hook for suspending the ladder from a window sill or the like. The same, normally upper section is provided with winch and brake means for controlling the extension of the ladder by gravity by operating same from the top end thereof. The lowermost section is provided with support wheels facilitating the manipulation of the ladder over obstructions such as a lower window sill or the like as the ladder is being extended. The ladder also has means for locking same in an extended state, whereby the ladder becomes generally rigid to facilitate handling from the bottom end. The ladder is particularly suitable as a portable fire escape ladder but has many other applications as well.

4 Claims, 8 Drawing Figures

EXTENSIBLE LADDER

The present invention relates to an extensible ladder of the type having a plurality of sections slidably received within one another and having each a pair of side pieces and a plurality of rungs extending therebetween.

The above type of ladder is well known from the art. Reference may be had to Canadian Pat. No. 664,137 issued June 4, 1963 to Nilsson. Reference can also be made to Canadian Pat. No. 139,768 issued Apr. 16, 1912 to Chickering, which shows that it is known to provide the normally upper end of a ladder with hooks facilitating the suspension of the ladder from an object such as a window sill or the like.

The design of different types of extensible ladders is more or less satisfactory, yet, all of the known ladders of this type are characterized by the feature of the mechanism for controlling the extension of the ladder being located at the bottom of the ladder such that, in operation, the ladder is normally extended first and then placed into its appropriate position. This may be of disadvantage when the ladder is to be used for instance as a portable fire escape ladder. If a ladder provided with the hooks at the top end thereof is to be relatively easy to handle, it has to stay in folded state while being placed in position. Only after the ladder is secured to a window sill or the like is it desirable that the ladder be extended to the required length. This manipulation would be difficult with the known ladders of this type since the controls of the extension are normally at the bottom.

It is an object of the present invention to provide a ladder of the aforesaid type that, on the one hand, is capable of becoming extended and maintained in a generally rigid extended state, while, on the other hand, enabling the control of the extension of the ladder by simple, relatively inexpensive, mechanical means when the ladder is being lowered from, say, a first floor window down to the ground.

According to the present invention, an extensible ladder is provided of the type having a plurality of sections slidably received within one another and having each a pair of side pieces and a plurality of rungs extending therebetween; one of said sections being a normally upper section and having a normally top end; hook means secured to said normally upper section and protruding upwardly and away from a plane generally defined by said side pieces, for securing said upper section to an object to suspend the ladder; cord means having one end secured to a normally lowermost section of the ladder, the other end of said cord means being secured to manually operable reel means disposed in proximity of said top end of the upper section and secured to same; whereby the length of extension of the ladder in a suspended state can be controlled by operating said reel means allowing the ladder to extend by gravity.

Preferably, the ladder further comprises manually operable brake means disposed at said top end and arranged to control the speed at which the cord means unwinds from said reel means; whereby the speed of extension of the ladder in a suspended state can be controlled. It is also preferred that the ladder comprise manually releasable blocking means disposed at said top end and being of the type adapted to block the movement of said cord means away from said reel means; whereby the length of extension of the ladder in a suspended state can be controlled by blocking said cord means at a selected point.

The ladder may further comprise releasable lock means for locking respective adjacent sections of the ladder in a mutually extended position; whereby the ladder can assume a generally rigid extended state to enable its handling from the lower end thereof.

According to a still further feature of the present invention, a bottom end of said normally lowermost section is provided with supporting wheels pivotable about an axis generally parallel with the rungs of said ladder, the periphery of said wheels protruding both downwardly beyond the bottom end of the ladder, and out of a plane generally coincident with the sidepieces of the ladder, the sense of the latter protruding being the same as that of said hook means.

The present invention will be described in greater detail with reference to the accompanying simplified, schematic drawings.

IN THE DRAWINGS

Figure 1:
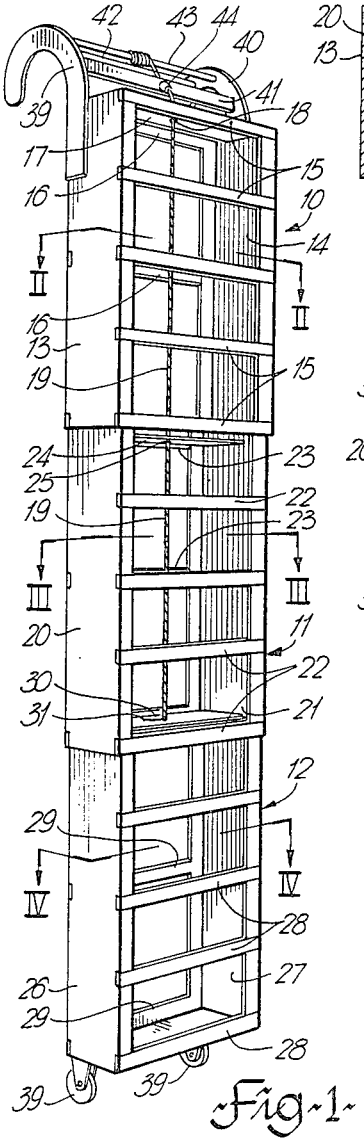
FIG. 1 is a schematic, perspective view of a ladder including the features of the present invention.
Figure 2:
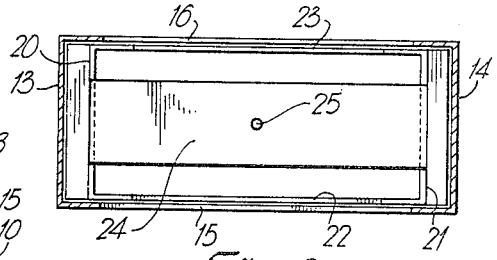
FIG. 2 is section II—II of FIG. 1.

FIG. 1 shows an extensible ladder of the above type, comprising an upper section 10, an intermediate section 11 and a lowermost or bottom section 12.

The upper section 10 has two upright channel-shaped side pieces 13, 14, and five rungs 15 extending therebetween and fixedly secured to the front of the side pieces 13, 14. The rear surface of the side pieces is provided with braces 16 one at each end of the side pieces 13 and one therebetween. Thus, the side pieces 13, 14, the rungs 15 and the connectors 16 form a box-shaped structure. The top ends of side pieces 13, 14 are also connected to each other by a transverse plate 17. Disposed centrally of the plate 17 is a passage opening 18 through which a rope 19 can freely pass.

The structural configuration of the intermediate section 11 is generally the same as described above with reference to section 10. It has two side pieces 20, 21, four rungs 22, three braces 23 (only two visible in FIG. 1) and a plate 24 having therein a passage 25 for the rope 19.

The structural configuration of section 12 is also generally identical and includes side pieces 26, 27, rungs 28, braces 29, plate 30 with a centrally located passage for the rope 19.

The end of the rope 19 passes through the passage of plate 30 and is tied off as indicated by reference numeral 31.

Due to the gradually decreasing size of sections 10, 11 and 12, it will be apparent that the sections can be slidably received within one another. As clearly shown in FIG. 1 and FIG. 4, the side pieces 26, 27 of the lowermost or bottom section 12 are flat rather than channel shaped as in the case of side pieces 13, 14, 20, and 21.

Figure 3:
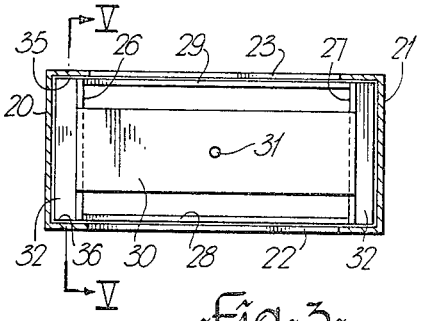
FIG. 3 is section III—III of FIG. 1.
Figure 5:
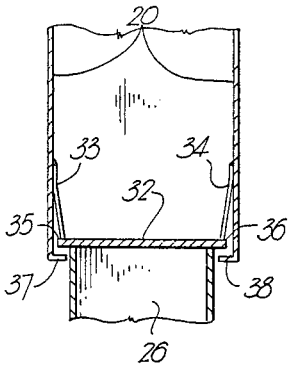
FIG. 5 is a simplified sectional view V—V of FIG. 3 with certain parts omitted for the sake of clarity.

Turning now to FIG. 5 and also to the representation of FIG. 3, it will be seen that the ends of plate 30 of the lowermost section are provided with end plates 32 whose dimensions generally correspond to the distance between the webs of the respective side pieces 20, 21. FIG. 5 shows that the flanges of side piece 20 are provided with flat springs 33, 34 (not shown in FIG. 3) whose lower ends engage the adjacent ends 35, 36 of the end plate 32. Thus, when the lowermost section 12 is fully extended relative to section 11, the springs prevent the two sections from sliding into each other, unless the springs 33, 34 are pushed sidewise (as viewed in FIG. 5). FIG. 5 also shows that the side piece 20 is provided at its bottom end with inwardly turned lips 37, 38 adapted to engage the end portions 35, 36 of the end plate 32.

Figure 4:
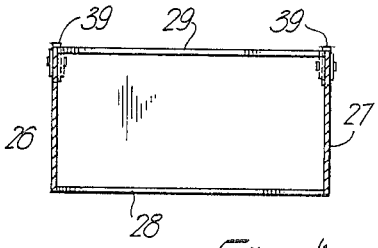
FIG. 4 is section IV—IV of FIG. 1.

Turning again to FIG. 1 and also to FIG. 4, it will be seen that two wheels 39 are provided at the bottom of the lowermost section 12. The periphery of the wheels protrudes below the lowermost portion of the ladder and slightly over its rear surface as best seen in FIG. 4.

Figure 8:
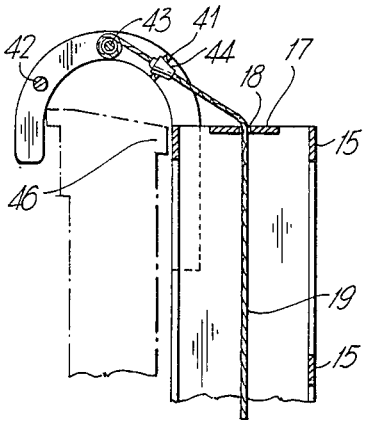
FIG. 8 is a schematic side view partly in section, of the upper end of the ladder, showing how the ladder can be secured to a window sill.
Figure 7:
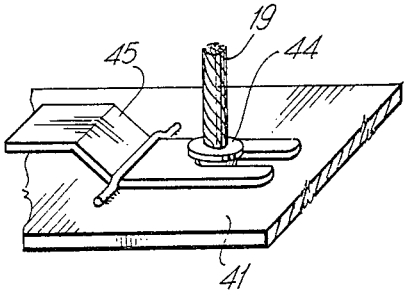
FIG. 7 is a schematic perspective view of detail VII of FIG. 1.
Figure 6:
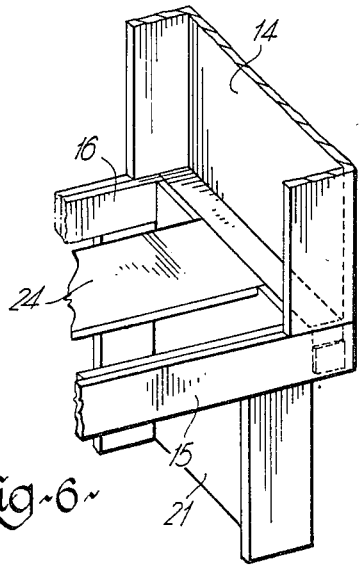
FIG. 6 is an enlarged perspective view of detail VI of FIG. 1.

Fixedly secured to the side pieces 13, 14 of the upper section 12 are two hook members 39, 40 interconnected by a brace 41 and by two rungs 42, 43, of which rung 43 is pivotable in the respective portions of hooks 39, 40. Wound on the rung 43 is the upper end portion of the rope 19. Accordingly, the rope 19 can be stored on the rung 43, wound on same or unwound from same. Disposed centrally of the brace 41 is a drag member 44 (FIGS. 8 and 7), of the type well known from instance from cloth line tighteners. In general, it consists of a body and of an axially displaceable member, whose top portion is shown in FIG. 7. On displacement of the upper member inside the body of the drag member, a radially inward pressure of the upper member on the rope 19 prevents sliding of the rope 19 downwardly as viewed in FIG. 8 or in FIG. 1. The drag member 14 thus can assume either a fully locked position wherein the passage of rope 19 downwards is totally prevented, or it can be partly released to merely frictionally brake line 19. The axial displacement of the upper portion of member 44 is effected by a thumb press lever 45 (shown only in FIG. 7).

In operation, a fully folded ladder is first placed over a member such as a window sill 46 (FIG. 8), with the line 19 wound up on the pivotal rung 43. Subsequently, the thumb press lever 45 is depressed below for passage of line 19 through same. Since at the outset the sections 12 and 11 are stacked within the section 10, the release of the drag member 44 will result in the intermediate section 11, (with the section 12 within same) descending downwards until it reaches the terminal position as shown in FIG. 1. Thereupon, the lowermost section 12 proceeds to extend downwardly from the intermediate section 11 until the fully extended state as shown in FIG. 1 is reached. The wheels 39 facilitate overcoming objections that the ladder may encounter during its stage of being extended, such as window sills located below the place of suspension or the like. Since the wheels are also slightly offset backwards of the ladder, they prevent the ladder from damaging the wall of the building. On full extension, the locking members 33, 34 of all respective sections are in a position as in FIG. 5. Accordingly, the ladder is now a rigid structure that can be handled from beneath, while its extension is fully handled from the region of the hooks 39, 40 on top.

Those skilled in the art will readily conceive further embodiments of the invention which may, to some degree, depart from the above embodiment which is preferred due to the fact that it secures the function and is inexpensive. Thus, one can readily conceive a more complex arrangement of a winch instead of the pivotal rung 43 as described above. The winch itself may be provided with a brake or locking mechanism that may conceivably replace the drag member 44. In the preferred embodiment, the uppermost section 10 is the one having the largest cross-sectional dimension. One can readily see, however, that only minor modifications would be required to reverse the ladder such that the section 12 of FIG. 1 would become the uppermost section.

These and many other embodiments do not depart from the scope of the present invention as defined in the accompanying claims.

The embodiments of the invention in which an exclusive property or privilege is claimed are defined as follows:

1. An extensible ladder of the type having a plurality of sections slidably received within one another and having each a pair of side pieces and a plurality of rungs extending therebetween;

one of said sections being a normally upper section and having a normally top end;

hook means secured to said normally upper section and protruding upwardly and away from a plane generally defined by said side pieces, for securing said upper section to an object to suspend the ladder;

cord means having one end secured to a normally lowermost section of the ladder, the other end of said cord means being secured to manually operable reel means disposed in proximity of said top end of the upper section and secured to same;

wherein a bottom end of said normally lowermost section is provided with supporting wheels pivotable about an axis generally parallel with the rungs of said ladder, the periphery of said wheels protruding both downwardly beyond the bottom end of the ladder, and out of a plane generally coincident with the sidepieces of the ladder, the sense of the latter protruding being the same as that of the hook means.

2. A ladder as claimed in claim 1, further comprising manually operable brake means disposed at said top end and arranged to control the speed at which the cord means unwinds from said reel means;

whereby the speed of extension of the ladder in a suspended state can be controlled.

3. A ladder as claimed in claim 1, further comprising manually releasable blocking means disposed at said top end and being of the type adapted to block the movement of said cord means away from said reel means;

whereby the length of extension of the ladder in a suspended state can be controlled by blocking said cord means at a selected point.

4. A ladder as claimed in claim 1, 2 or 3, further comprising releasable lock means for locking respective adjacent sections of the ladder in a mutually extended position;

whereby the ladder can assume a generally rigid extended state to enable its handling from the lower end thereof.

* * * * *